US005412839A

United States Patent [19]

McCollom

[11] Patent Number: 5,412,839

[45] Date of Patent: May 9, 1995

[54] SOFT TOUCH APPLIANCE HANDLE ASSEMBLY

[75] Inventor: Perry C. McCollom, Louisville, Ky.

[73] Assignee: General Electric Company, Louisville, Ky.

[21] Appl. No.: 178,798

[22] Filed: Jan. 7, 1994

[51] Int. Cl.[6] ..... A47B 95/02

[52] U.S. Cl. ..... 16/111 R; 16/124; 16/DIG. 19; 49/460; 312/405

[58] Field of Search ..... 312/405; 49/460; 16/110 R, 111 R, 116 R, 124, 125, 112, DIG. 5, DIG. 19

[56] References Cited

U.S. PATENT DOCUMENTS

| | | | |
|---|---|---|---|
| 3,060,523 | 10/1962 | Benham | 49/460 |
| 3,107,389 | 10/1963 | Engelbrecht | 16/124 |
| 3,203,697 | 8/1965 | Berzatzy | 16/111 R |
| 3,500,973 | 3/1970 | Bush | 16/111 R |
| 4,574,424 | 3/1986 | Reis | 16/124 |
| 4,745,656 | 5/1988 | Revlett | 16/DIG. 19 |
| 4,803,755 | 2/1989 | Pohlman | 16/116 R |

FOREIGN PATENT DOCUMENTS

| | | | |
|---|---|---|---|
| 827325 | 2/1960 | United Kingdom | 16/124 |
| 936412 | 9/1963 | United Kingdom | 16/111 R |

*Primary Examiner*—Lowell A. Larson
*Assistant Examiner*—Donald M. Gurley
*Attorney, Agent, or Firm*—H. Neil Houser

[57] ABSTRACT

A refrigerator includes a cabinet and an access door with a front and sides. A door handle includes an elongated base portion extending along one side of the door and an elongated grasping portion overlapping and spaced forward of the door front. A first recess is formed on the door side of the distal edge of the grasping portion of the handle and a second recess is formed on the door side of the handle and spaced from the first recess. An elongated liner of soft feel, wear resistant material is received in the recesses and extends across the grasping portion.

15 Claims, 1 Drawing Sheet

SOFT TOUCH APPLIANCE HANDLE ASSEMBLY

BACKGROUND OF THE INVENTION

It has become desirable to provide household appliances, and particularly refrigerators, with "soft feel" handles, that is handles which feel "soft to the touch" of users. At the same time it has become desirable to provide long handles; for example, refrigerator handles which extend substantially all along the vertical edges of doors for side-by-side refrigerator/freezers. It is difficult to provide a soft feel for such elongated handles and the normal soft feel inserts presently used for shorter handles would be very expensive if made of sufficient length for elongated side-by-side door handles.

It is an object of this invention to provide an improved soft feel handle assembly for an appliance, such as a refrigerator.

It is another object of this invention to provide such an improved soft feel handle in an appliance with an elongated door.

It is yet another object of this invention to provide such an improved soft feel handle assembly which is economical and easily assembled.

SUMMARY OF THE INVENTION

In accordance with one embodiment of this invention there is provided a refrigerator with a cabinet and a door providing access to the interior of the cabinet. The door includes a front, a back and elongated sides. A handle assembly includes an elongated base portion attached to and extending along one side of the door and an elongated grasping portion overlapping and spaced forward of the door front. The distal edge of the grasping portion is return bent to form a first elongated recess on the door side of the grasping portion and a second elongated recess is formed on the door side of the handle and to the opposite side of the grasping portion from the first recess. An elongated soft feel liner has lateral edges received within the recesses and extends across the grasping portion of the handle.

DETAILED DESCRIPTION OF PREFERRED EMBODIMENT

Figure 1:
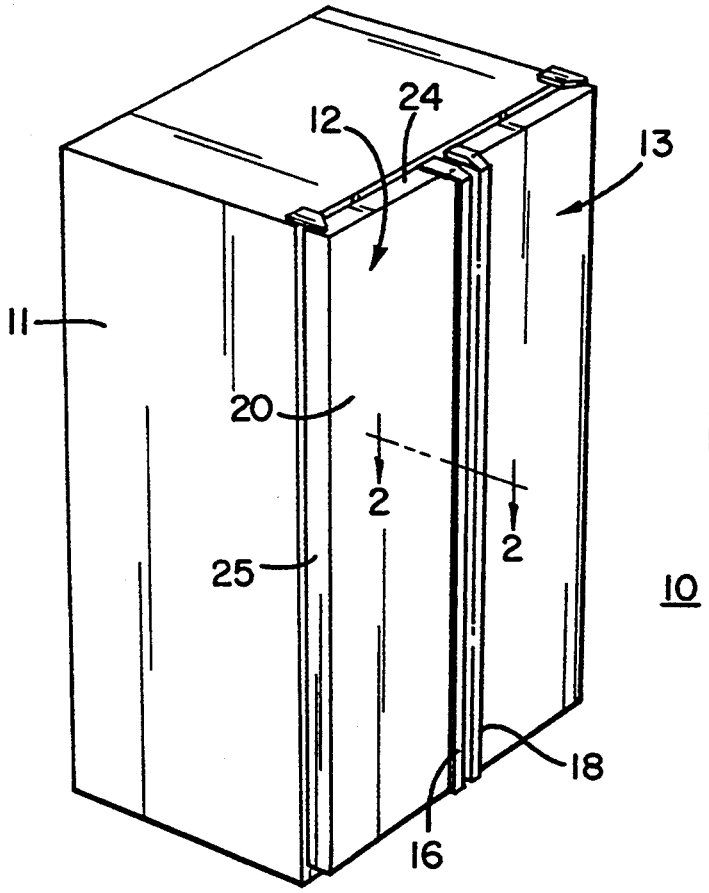
FIG. 1 is a simplified front perspective view of a side-by-side type of household refrigerator incorporating an exemplification embodiment of the present invention.

Referring now particularly to FIG. 1, there is illustrated a household refrigerator 10 of the well known side-by-side type, that is the cabinet 11 includes a fresh food compartment and a freezer compartment arranged in a side-by-side configuration. Each of the compartments has a front access opening normally closed by hinged doors 12, 13 respectively. The particular refrigerator configuration shown is for illustrative purposes only and it will be understood that the present invention is useful with other appliances, particularly with other types of refrigerators; such as, for example, top mount refrigerators in which the freezer is positioned above the fresh food compartment. Various internal components of a refrigerator, such as the refrigeration system and the storage shelves are not involved in the present invention and have been omitted for the sake of simplicity.

Figure 2:
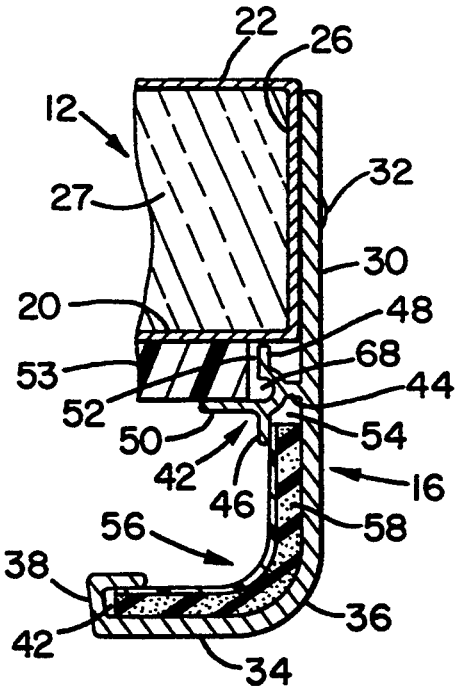
FIG. 2 is a somewhat schematic, fragmentary cross section view of a portion of a door of the refrigerator of FIG. 1, as seen along line 2—2 in FIG. 1.

The doors 12,13 are provided with handles 16, 18, respectively by which a user can open and close that door for access to the corresponding compartment. Referring now more particularly to FIGS. 1 and 2, it will be seen that the door 12 includes a front panel 20, a rear panel 22 and side panels in the form of a top 24, left 25 and right 26 lateral edges or panels. There also is a bottom edge or panel, not shown. The door panels form an enclosed space which conveniently is filled with suitable insulation material 27. It will be understood that the door is illustrated as a simple box like structure for the sake of simplicity and ease of understanding. Normally the front and side walls or panels are formed from an unitary sheet of structural material, often steel, which is bent into the desired shape. The inner or back panel or wall 22 normally is molded from an appropriate plastic material and includes formed-in-place shelves or shelf mounts for storing items to be refrigerated.

The handles 16,18 extend substantially from the top to the bottom of doors 12,13. The handles and their mode of mounting on the doors are the same. Therefore only handle 16 has been shown in detail and will be described. As best seen in FIG. 2, handle 16 includes an elongated base portion 30 which extends along and overlies side wall 26 and projects forward of and substantially at a right angle to door front panel 20. The base portion 30 is connected to the edge 26 by any suitable means, such as, for example, threaded connectors 32 which extend through the base portion and are received in the edge. Handle 16 also includes a grasping portion 34 which overlies, is spaced forward of and is parallel to the door front panel 20. Preferably the grasping portion 34 and base portion 30 are joined by a smoothly curved or radiused portion 36.

The distal edge of the grasping portion 34 is return bent at 38 to form a first recess 40 on the door side of the grasping portion. Just forward of the front of the door 12, an elongated integral web 42 is formed on the door side of the base portion 30. The web includes a foot 44, projecting away from the base portion 30; arms 46, 48 which are generally parallel to the base portion 30 and project away from and toward the door respectively; and an arm 50 which projects inwardly and overlaps the door front panel and is spaced therefrom.

The handle preferably is integrally formed from a continuous strip of a suitable material. Presently the preferred material is extruded aluminum. However, other materials can be used so long as they provide suitable structural strength and rigidity. By way of example only, the handle could be formed from roll formed aluminum or powder coated steel.

The arm 48 is sized and positioned to engage the front of door front panel 20 when the handle 16 is mounted on the door. In this manner the arm 48 serves to properly align the handle with the door for insertion of the fasteners 32 or for the use of another means of attachment, such as an adhesive. In addition, the engagement of the arm 48 with door panel 20 along the length of handle 16 helps maintain the door/handle integrity and provide a straight "away from the cabinet" force on the door, regardless of where the user grasps the handle.

The arm 50, together with the adjacent section of the door front panel 20 form a recess 52 which opens across the door. It is often desirable to provide users the opportunity to use decorative panels of their choice on the front of appliances like refrigerators and the recess 52 conveniently can be used to mount one side edge of a suitable decorative panel like that shown at 53.

The arm 46 together with the adjacent section of base portion 30 form a recess 54 open toward the grasping portion 34 and positioned on the other side of grasping portion and curved portion 36 from the first recess 42. A soft feel insert or liner 56 is mounted on the door side of the handle. More specifically, the liner is formed from a sheet of soft foam 58 covered by a sheet of flexible, wear resistant material 60. Preferably the liner 56 is made from a sheet of polyurethane foam with a sheet of vinyl of the kind known as Naugahide laminated to it. Preferably the polyurethane is between about $\frac{1}{8}$ inch and about 3/16 inch thick and the Naugahide is between about 0.20 inch and about 0.030 inch thick. However, it will be understood that other combinations of materials can be used so long as they provide an appropriate "soft feel" when grasped by an user and will stand up to the very large number of door openings which occur during the normal life of a refrigerator.

The liner 56 is mounted on the door side of the handle 16 by inserting the lateral edge sections 62, 64 of the liner into the recesses 42,54 respectively, with the wear resistant cover 60 toward the door. The preferred liner 56, as described above, has sufficient flexibility for ease of insertion in the handle while having sufficient stability when seated to stay in place without the need of an adhesive between the liner and the handle.

Figure 3:
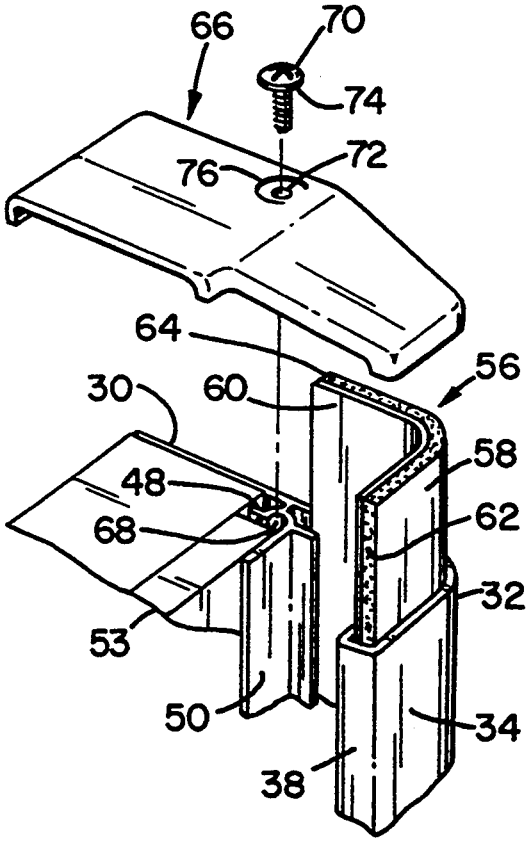
FIG. 3 is a fragmentary, exploded view of the upper corner of the door of FIGS. 1 and 2.

Referring now to FIG. 3, a cap or cover 66 may be mounted over the ends (the top and bottom) of the handles. For that purpose the web 42 includes an opening 68 of generally circular cross section at the junction of arms 46, 48 and 50. A cap 66 is placed over a corresponding end of the handle and door and a threaded fastener, such as screw 70, passes through an opening 72 in the cap and is threadedly received in the opening 68 in web 42 until the head 74 of the screw seats in recess 76 in the cap around the opening 72.

While a specific embodiment of the present invention has been illustrated and described herein, it is realized that modifications and changes will occur to those skilled in the art to which it pertains. It is intended therefore that the appended claims cover all such modifications and changes as fall within the true spirit and scope of the invention.

What is claimed is:

1. A refrigerator, including:

a cabinet defining a refrigerated space;

a door hingedly mounted to said cabinet for providing access to said refrigerated space, said door including a front panel and elongated side panels;

a door handle including an elongated base portion attached to and extending along one of said door side panels and an elongated grasping portion overlapping and spaced forwardly of said door front panel;

said grasping portion including a distal edge return bent into a first elongated recess on the door side of said grasping portion and means forming a second elongated recess on the door side of said handle and spaced from said first recess;

an elongated soft feel liner formed from a layer of soft foamed plastic material with a wear resistant cover laminated to one side thereof, said liner having lateral edge portions received in said recesses and extending across the door side of said grasping portion of said handle with said wear resistant cover facing said door.

2. A refrigerator as set forth in claim 1, wherein: said foamed plastic material is polyurethane and said wear resistant cover is a vinyl.

3. A refrigerator as set forth in claim 2, wherein: said polyurethane is about $\frac{1}{8}$ inch thick and said vinyl cover is about 0.020 inch thick.

4. A refrigerator as set forth in claim 1, wherein, said base and grasping portions of said handle are joined by a smoothly curved portion and said soft feel liner extends across said smoothly curved portion.

5. A refrigerator as set forth in claim 1, wherein: said handle is integrally formed from a continuous strip of structurally strong material.

6. A refrigerator as set forth in claim 5, wherein: said handle is formed of extruded aluminum.

7. A refrigerator as set forth in claim 1, wherein: an elongated web is integrally formed on the door side of said handle base portion; said web forming said second elongated recess and including a first lip abutting said door front panel.

8. A refrigerator as set forth in claim 7, wherein: said web includes a second lip projecting parallel to and spaced from said door front; and a decorative panel is positioned over said door front panel; a said first and second lips forming a recess receiving a lateral edge of said decorative panel.

9. A refrigerator as set forth in claim 7, further including; a cap positioned over an end of said handle and threaded attachment means extending through said cap and received in said web.

10. An appliance including:

a cabinet and a door mounted to provide access to the interior of said cabinet; said door including a front panel and a rear panel joined by elongated side panels:

an elongated extruded handle including a base portion attached to and extending along one of said door side panels; said handle also including a grasping portion overlapping and spaced forward of said door front panel and joined to said base portion by a smoothly curved portion;

said grasping portion including a distal edge return bent into a first elongated recess on the door side of said grasping portion;

said handle also including a web on the door side of said base portion and forming with said base portion a second elongated recess;

an elongated soft feel liner having lateral edge portions received in said first and second recesses and extending across said curved and grasping portions of said handle.

11. An appliance as set forth in claim 10, wherein: said web includes a first lip for aligning said handle with said door.

12. An appliance asset forth in claim 11, wherein: said web includes a second lip overlapping and spaced forward of said door front panel and forming with said first lip a recess to receive a lateral edge of a panel mounted over said door front.

13. An appliance as set forth in claim 10, wherein: said soft feel liner is formed from a sheet of soft plastic foam covered with a layer of flexible, wear resistant material.

14. An appliance as set forth in claim 13, wherein: said sheet of soft foam is polyurethane and said flexible, wear resistant layer is vinyl.

15. An appliance as set forth in claim 14, wherein: said handle is formed from extruded aluminum.

* * * * *